US006959980B2

(12) United States Patent
Heberling et al.

(10) Patent No.: US 6,959,980 B2
(45) Date of Patent: Nov. 1, 2005

(54) ESD SHIELDING OF INK-JET PRINTER

(75) Inventors: Robert L. Heberling, Camas, WA (US); Duane Evans, Vancouver, WA (US); William Jennings, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 68 days.

(21) Appl. No.: 10/650,381

(22) Filed: Aug. 27, 2003

(65) Prior Publication Data

US 2005/0046670 A1 Mar. 3, 2005

(51) Int. Cl.[7] ..... B41J 2/14; B41J 2/16
(52) U.S. Cl. ..... 347/50
(58) Field of Search ..... 347/20, 56, 61, 347/63, 65, 67, 49, 50, 84–87, 37

(56) References Cited

U.S. PATENT DOCUMENTS

| | | | | |
|---|---|---|---|---|
| 5,359,357 A | | 10/1994 | Takagi et al. | 347/86 |
| 5,491,505 A | | 2/1996 | Suzuki et al. | 347/56 |
| 5,635,968 A | | 6/1997 | Bhaskar et al. | 347/59 |
| 5,748,209 A | | 5/1998 | Chapman et al. | 347/50 |
| 5,971,525 A | * | 10/1999 | Inoue et al. | 347/50 |
| 6,168,262 B1 | | 1/2001 | Clark et al. | 347/68 |
| 6,361,150 B1 | | 3/2002 | Schulte et al. | 347/56 |
| 2003/0090547 A1 | | 5/2003 | Imanaka et al. | |

FOREIGN PATENT DOCUMENTS

| | | |
|---|---|---|
| EP | 0 993 954 | 4/2000 |
| EP | 0 641 667 | 11/2001 |
| EP | 04016762 | 9/2004 |
| JP | 6143555 | 5/1994 |

* cited by examiner

*Primary Examiner*—Juanita D. Stephens

(57) ABSTRACT

The carriage connection flex cable of an ink-jet printer is provided with an extended portion that contacts the pen during insertion into the carriage and shunts electrostatic discharge (ESD) from the pen to ground before full insertion of the pen.

34 Claims, 3 Drawing Sheets

ESD SHIELDING OF INK-JET PRINTER

BACKGROUND

Ink-jet printers enable non-contact printing of both color and black and white text, graphics and digital still camera images while eliminating many types of failures or limitations encountered with older impact printers and dot matrix printers. An ink-jet printer utilizes a replaceable ink cartridge commonly referred to as a pen which is installed in a receptacle or chute of a pen carriage that reciprocates laterally during a printing operation as the paper or other print media is driven longitudinally through the printer.

Both the ink-jet pen and the ink-jet printer contain sensitive electronic components that are susceptible to permanent damage from electrostatic discharge (ESD) which can reach levels of 15 kV and higher. User insertion of a pen into the carriage of the printer is regularly required when an empty pen is replaced. The user will often build up a static charge on his or her body walking across carpet which is transmitted to the pen that is held in his or her hand. Subsequent ESD can damage the pen before it is ever inserted into the printer carriage. However, an even more costly event can occur if the ESD, during pen insertion damages an integrated circuit (IC) on a printed circuit assembly (PCA) in the carriage that is connected directly to the dimples on the carriage connection flex cable.

DETAILED DESCRIPTION

Figure 1:
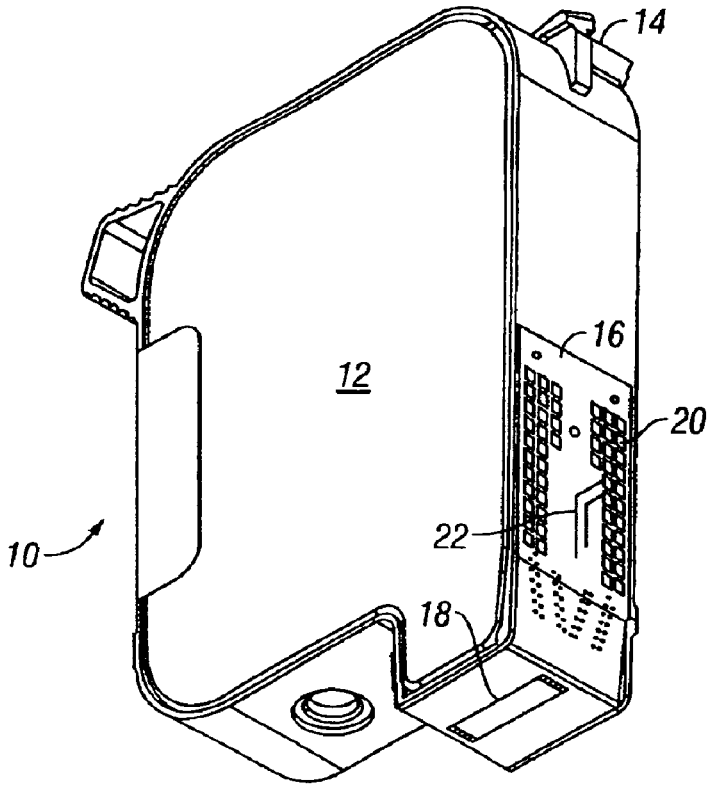
FIG. 1 is a perspective view of an ink-jet pen.

Referring to FIG. 1, an ink-jet pen 10 comprises an outer rectangular pen housing 12 with suitable projections and/or notches 14 for precision registration in the carriage. The pen housing 12 encloses at least one ink reservoir (not visible). A pen flex cable 16 wraps around a corner of the pen housing 12. One end of the pen flex cable 16 electrically connects with a plurality of resistors in a monolithic structure (not visible) associated with a nozzle plate 18 on a first side surface of the pen housing 12. Other ink-jet pen types may be used besides the thermal type, such as those employing piezoelectric devices. The other end of the pen flex cable 16 provides a plurality of electrically conductive contacts 20 on an adjacent second side surface of the pen housing 12. The pen housing 12 may be made of carbon filled plastic, although a static discharge can build up on the surface of other material from which the housing 12 can be fabricated. Substantial electrostatic charge can build up in the pen housing 12, particularly in dry climates, and especially when carried in the hand of a user who shuffles his or her feet over carpeting. The pen flex cable 16 may be made of a thin tape made of a suitable high strength plastic such as KAPTON® polyamide. Conductive traces such as 22 are formed on the pen flex cable 16 for providing electrical connection between the resistors and the conductive contacts 20. See for example U.S. Pat. No. 5,748,209, the entire disclosure of which is hereby incorporated by reference.

Figure 2:
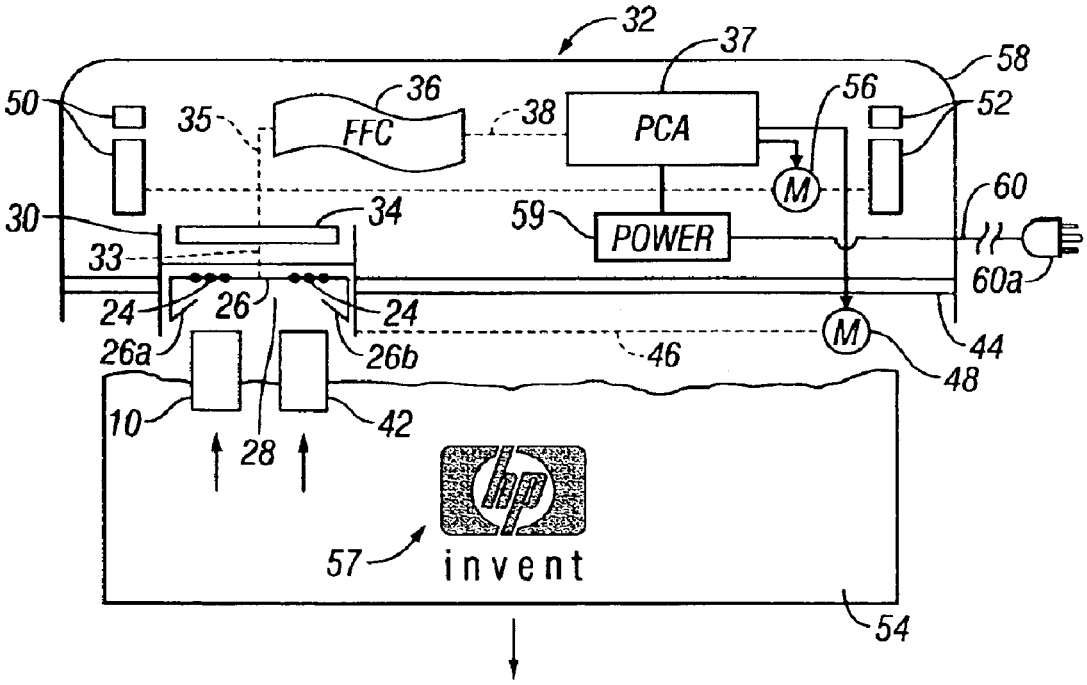
FIG. 2 is a diagrammatic top plan view of an embodiment of the present invention in which the carriage connection flex cable of an ink-jet printer has extended portions for shunting to ground ESD from either of two pens.
Figure 3:
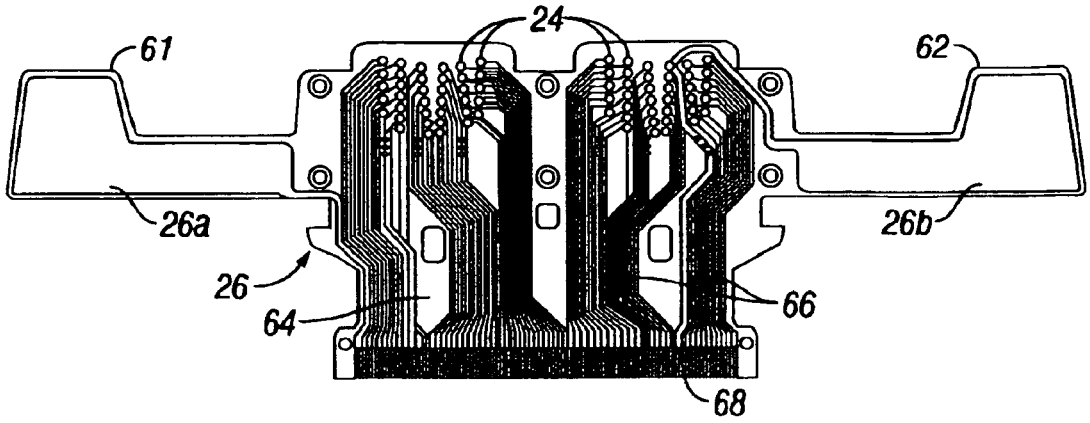
FIG. 3 is a top plan view of one configuration of the carriage connection flex cable utilized in the illustrated embodiment laid flat and before folding and mounting in the carriage of the printer of FIG. 2.

In accordance with the illustrated embodiment of the present invention, the contacts 20 (FIG. 1) of the pen 10 register with one set of corresponding raised conductive dimples 24 (FIG. 3) on the outer terminal end of a carriage connection flex cable 26 when the pen 10 is fully inserted into one side of a forwardly opening chute 28 (FIG. 2) of a carriage 30 of an ink-jet printer 32. The inner end of the carriage connection flex cable 26 is mated via suitable connector 33 to a carriage printed circuit assembly (PCA) 34. A suitable connector 35 connects the carriage PCA 34 to one end of a trailing flat flexible cable (FFC) 36. The other end of the trailing FFC 36 is connected to a stationary main PCA 37 through another suitable connector 38. The raised conductive dimples 24 on the carriage connection flex cable 26 receive various drive signals from the pen driver electronics on the carriage PCA 34. The digital data that allows the carriage PCA 34 to generate these drive signals comes from the main PCA 37 via FFC 36. The drive signals could also be generated on the main PCA 37 and be sent to the conductive dimples 24 via the FFC 36 and the PCA 34. The flexibility of the FFC 36 accommodates the reciprocating motion of the carriage 30, if any. The carriage 30 supports at least one color ink pen 10 or a black ink pen 42 in side-by-side relation within the carriage 30. In this arrangement the terminal end of the carriage connection flex cable 26 has two separate sets of dimples 24 as best seen in FIG. 3 which provide electrical connection with the separate sets of contacts of 20 the two different pens 10 and 42.

Referring again to FIG. 2, the carriage 30 is slidably supported on a rail 44 for lateral reciprocation via belt drive 46 that is driven by belt motor 48 controlled by the belt motor drive electronics on the main PCA 37. Sets of pinch rollers 50 and 52 at opposite ends of the printer 32 propel a sheet of paper or other media 54 longitudinally through the printer 32. The pinch rollers 50 and 52 are driven by a motor 56 controlled by motor drive electronics on the main PCA 37. As the sheet of media 54 is propelled longitudinally through the printer 32 the pens 10 and 42 reciprocate laterally to print alphanumeric and/or graphic information on the media 54 such as that depicted at 57 in FIG. 2. The components of the printer 32 just described are supported on a common housing or frame denoted graphically at 58 for the sake of simplicity. The frame 58 may have metal components that serve as a ground, which may be further effectuated by a ground connection through a power supply 59 and AC power cord 60 with a grounded three-prong plug 60*a*. In some embodiments, the printer may be of the page-wide array type in which the pens 10 and 42 do not move relative to the printer during printing.

Both the ink-jet pens 10 and 42 (FIG. 2) and the carriage PCA 34 contain sensitive electronic components that are susceptible to permanent damage from ESD from the pens 10 and 42 or any object during their insertion into the carriage 30. This ESD can reach levels of about 15 kV and higher. User insertion of a pen, such as the pen 10, into the carriage of the printer is regularly required when an empty pen is replaced. The user will often build up a static charge in his or her body walking across carpet which is transmitted to the pen 10 while it is held in his or her hand. Subsequent ESD can damage the pen 10 before it is ever inserted into the printer carriage 30. However, an even more costly event can occur if the ESD that occurs during insertion of either pen 10 or pen 42 damages an electronic component such as integrated circuit (IC) on the carriage PCA 34 in the printer that is connected directly to the conductive dimples 24 on the carriage connection flex cable 26. Therefore the carriage connection flex cable 26 has a pair of ears or extended portions 26*a* and 26*b* (FIG. 3) which are folded over and are angled rearwardly inside the chute 28. The flex cable 26 overlaps the three side walls of the carriage 30 as illustrated in FIG. 2. The extended portions 26*a* and 26*b* have conductive traces 61 and 62 (FIG. 3) which are forwardly exposed when the carriage connection flex cable 26 is mounted in the carriage 30.

When the color ink pen 10 is inserted into the left side of the carriage 30 as illustrated in FIG. 2, its pen housing 12 initially contacts the exposed conductive trace 61 on the folded over extended portion 26*a* and any ESD from the pen housing 12 travels through the connector 33 and through dedicated ground conductors in the carriage PCA 34 and the trailing FFC 36 to a ground conductor of the main PCA 37. Therefore the ESD from the pen 10 cannot damage or destroy any sensitive electronic components on the carriage PCA 34. Similarly when the black ink pen 42 is inserted into the right side of the carriage 30, its pen housing 12 initially contacts the exposed conductive trace 62 on the folded over extended portion 26*b*. Therefore any ESD from the pen 42 travels through the connector 33 and through dedicated ground conductors in the carriage PCA 34 and trailing FFC 36 to the same ground conductor of the main PCA 37 and also does not damage or destroy any sensitive electronic components on the carriage PCA 34. The ESD is shunted to ground before the pen 10 or 42 is operatively mounted in the carriage 30.

The carriage connection flex cable 26 may be made of KAPTON® polyamide or other suitable plastic film 64 with conductive traces 66 delineated thereon. The carriage connection flex cable is actually a flexible printed circuit (FPC). The traces 66 connect the raised sets of dimples 24 to a plurality of parallel conductors 68 that mate with the connector 33. The traces 61 and 62 that shunt ESD from the pens 10 and 42 to ground also lead to corresponding ones of the conductors 68. As the pens 10 and 42 are inserted, the corresponding extended portions 26*a* and 26*b* fold back rearwardly, allowing the conductive contacts 20 on the pens to mate with their corresponding conductive dimples 24. Each pen housing 12 physically contacts one of the extended portions 26*a* and 26*b* during an initial phase of insertion and folds them back. The resiliency of the carriage connection flex cable 26 results in the extended portions 26*a* and 26*b* springing back into their unfolded positions illustrated in FIG. 2 when the pens 10 and 42 are removed. This puts the extended portions 26*a* and 26*b* back into position to intercept any ESD from the next set of pens that are installed and shunt the same to ground. Of course it will be understood that usually only one pen is installed at a time since the ink stored in each of the pens 10 and 42 will typically be exhausted at different times. Moreover other objects may be inserted into the chute 28 such as a user's index finger and the extended portions 26*a* and 26*b* should extend a substantial distance in order to ensure that the objects are intercepted and any ESD shunted to ground.

Figure 4:
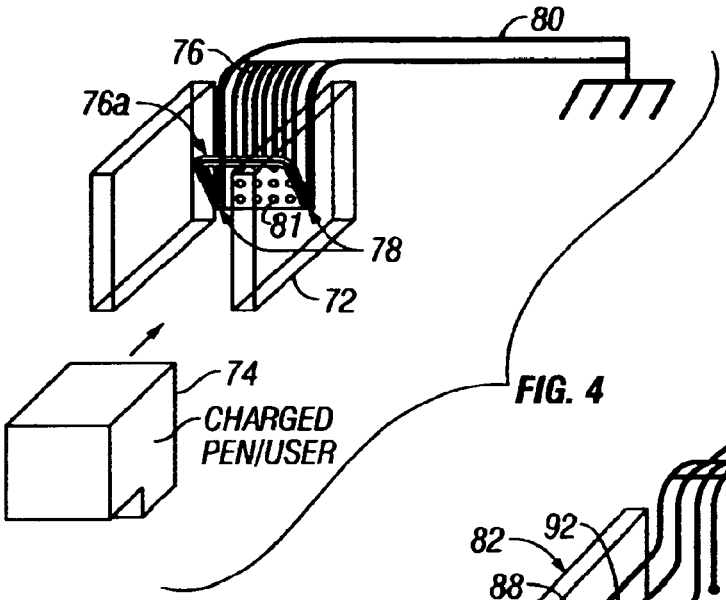
FIG. 4 is a conceptual illustration of an alternate embodiment of our invention.

FIG. 4 is a conceptual illustration of an alternate embodiment of our invention in which a carriage 72 is configured to receive a single pen 74. A carriage connection flex cable 76 has a single extended portion 76*a* which is bent and folded upwardly. The extended portion 76*a* has a forwardly exposed conductive trace 78 which forms a loop contact that touches the pen 74 before it is completely inserted into the carriage 72 and shunts ESD to ground through a ground path 80. The extended portion 76*a* folds back rearwardly and is sandwiched between the pen 74 and the rear wall of the carriage 72 when the pen 74 is fully inserted. The extended portion 76*a* is configured so that the conductive dimples 81 on the main part of the flex cable 76 are located in an open region bounded by the C-shaped extended portion 76*a*. Upon removal of the pen 74 the resilient extended portion 76*a* springs back forwardly into operative position for the next intercept.

Figure 5:
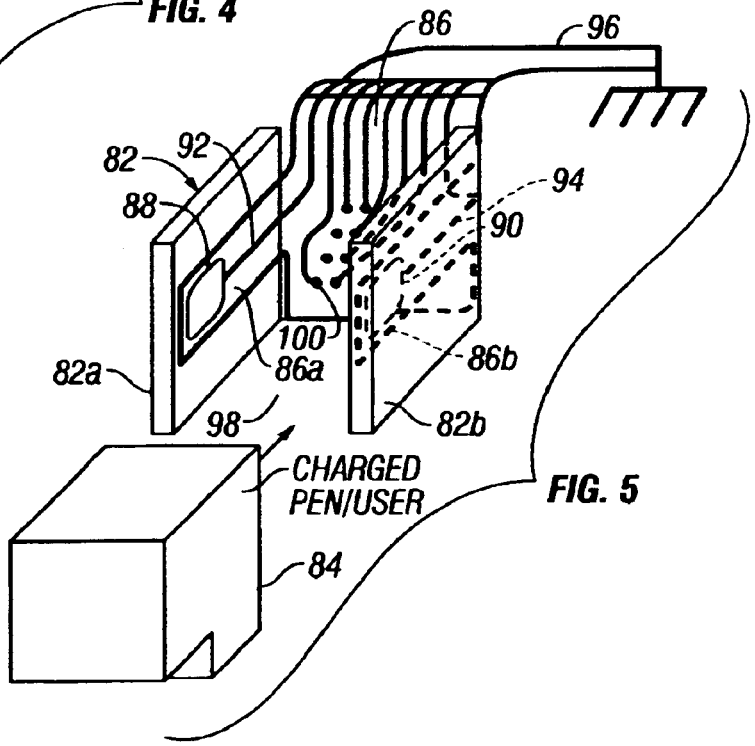
FIG. 5 is a conceptual illustration of yet another alternate embodiment of our invention.

FIG. 5 is a conceptual illustration of yet another alternate embodiment of our invention in which a carriage 82 is configured to receive a single pen 84. A carriage connection flex cable 86 has a pair of extended portions 86*a* and 86*b* which are secured to the inside surfaces of the sidewalls 82*a* and 82*b* of the carriage. The extended portions 86*a* and 86*b* have exposed conductive pads 88 and 90 which touch the pen 84 before it is completely inserted into the carriage 82 and shunt ESD to ground through conductive traces 92 and 94 that connect to a ground path 96. Maintenance of close spacing between the width of the pen 84 and the chute 98 of the carriage 82 ensures that the pen 84 will contact at least one of the conductive pads 88 and 90 before the conductive contacts 20 of the pen 84 mate with their corresponding conductive dimples 100 on the flex cable 86.

Figure 6:
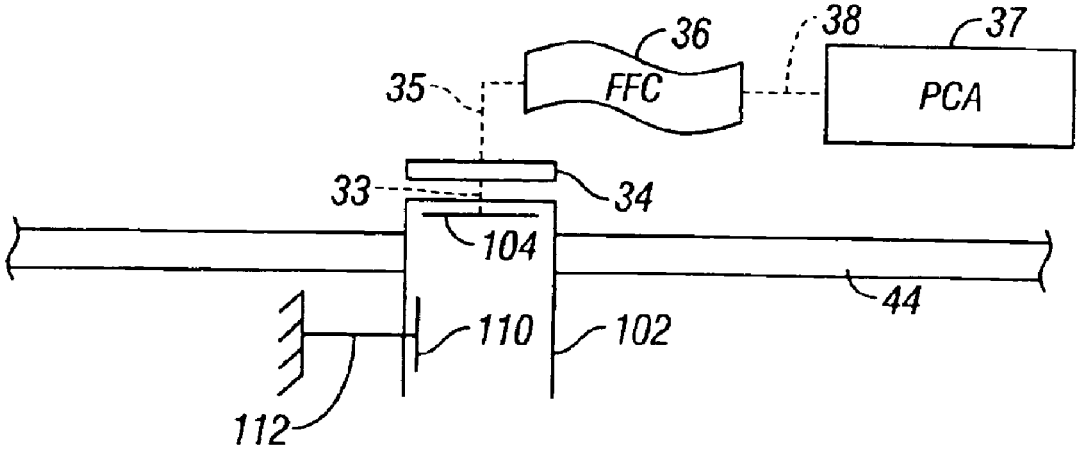
FIG. 6 is a diagrammatic top plan view of a printer carriage equipped with an alternate embodiment of the present invention in which the carriage is shunted to ground.
Figure 7:
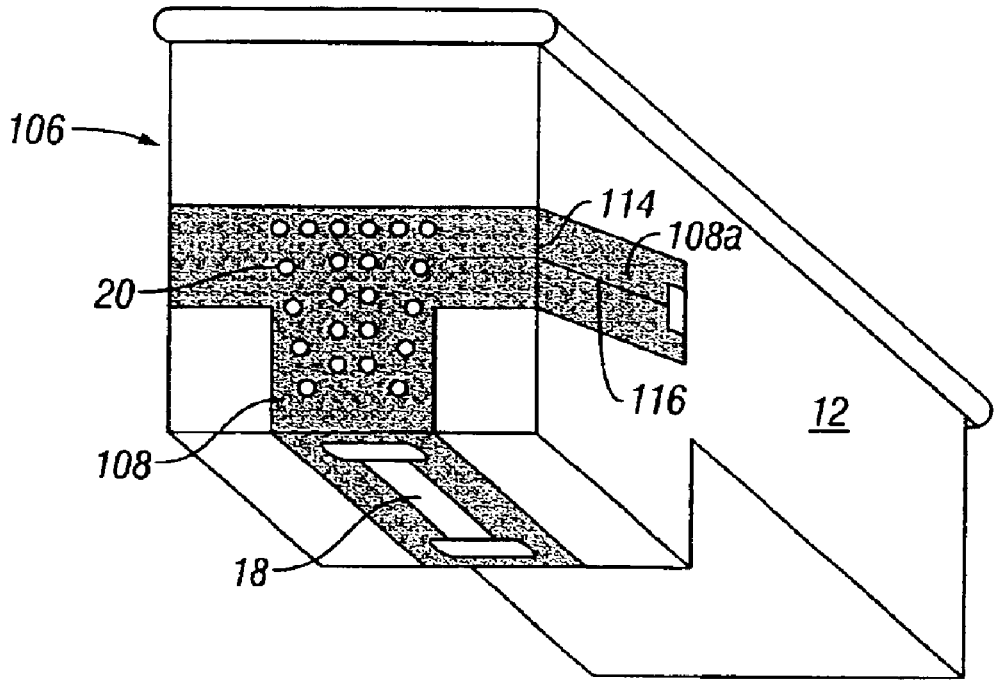
FIG. 7 is a diagrammatic illustration of a modified ink-jet pen having a pen flex cable with an extended portion for conveying ESD from the pen through the carriage of the printer of FIG. 6 and then to ground.

FIG. 6 is a diagrammatic top plan view of a printer carriage 102 equipped with an alternate embodiment of the present invention in which the carriage 102 is shunted to ground. A carriage connection flex cable 104 without any extended portions is installed in the carriage 102. FIG. 7 is a diagrammatic illustration of a modified ink-jet pen 106 having a pen flex cable 108 with a resilient flexible extended portion 108*a* for conveying ESD from the pen 106 to a conductive pad 110 mounted on the inside of the sidewall of the carriage 102 (FIG. 6) and then to ground via ground path 112. The extended portion 108*a* (FIG. 7) is not tacked or otherwise secured to the pen housing 12 but projects outwardly from the pen housing 12. A crease or fold line 114 on the corner of the pen housing operates as a hinge. When the pen 106 is removed from its packaging the extended portion 108*a* springs to its free floating intercept position in which it extends laterally away from the pen housing 12. When the pen is initially inserted into the carriage 102 an exposed region of a conductive trace 116 on the extended portion 108*a* of the pen flex cable 108 contacts the conductive pad 110 (FIG. 6) and any ESD from the pen 106 is shunted to ground. The extended portion 108*a* then folds rearwardly against the sidewall of the pen housing 12 and the conductive contacts 20 on the pen flex cable 108 register with their corresponding conductive dimples on the carriage connection flex cable 104. In a variation of embodiment illustrated in FIG. 7, the extended portion 108*a* of the pen flex cable 108 bends around the corner of the pen housing 12 and then has a hump or raised area (not illustrated) that projects laterally outward from the pen housing 12. The outer end of the extended portion 108*a* is tacked to the pen housing 12 and an exposed region of the conductive trace 116 that traverses the hump contacts the conductive pad 110 (FIG. 6) during insertion of the pen 106 into the printer carriage 102.

Thus those skilled in the ink-jet printer art will appreciate that we have provided several embodiments of a low cost, reliable solution that prevents ESD during pen insertion or any object from damaging sensitive electronic components of the printer itself These embodiments utilize extensions of either the pen flex cable or the carriage connection flex cable to intercept the pen before full insertion to allow ESD to be shunted to ground before it can be conducted to an electronic component mounted on the printer PCA. The resilience of the flex cable extensions ensures that they will initially remain in a predetermined free floating intercept orientation, will thereafter fold to a retracted orientation as the cartridge is progressively inserted, and upon pen removal, will spring back to their original intercept orientation. The exposed portions of the conductive traces 61, 62 and 78 and the conductive pads 88 and 90 that touch the pen housing 12 can be plated with gold to provide low ohm non-corroding contacts to ensure shunting of ESD. Other low ohmic plating metals and alloys can be used. The carriage connection flex cables 26, 76 and 86 can be fabricated from plastic film substrate with conductive traces formed thereon.

We have illustrated and described alternate hardware embodiments that use free floating flex cable extensions in the carriage and on the pen itself and another alternate embodiment that does not rely upon the extended portions in the carriage being free floating. We have also provided a method of shielding an electronic component of an ink-jet printer from ESD during insertion of a pen into the carriage of the printer. Our method comprises the steps of providing an extended flex cable portion and configuring and positioning the extended flex cable portion so that during insertion of the pen or any object into the carriage any ESD from the pen will be shunted to ground through the extended flex cable portion before any electrical connection is made between the pen and the electronic component. Thus, our invention is subject to a wide variety of modifications and adaptions. For example the pen 106 of FIG. 7 could be used with the carriage 82 so that the extended portion 108*a* of the pen flex cable 108 would make electrical contact with the conductive pad 88 to route ESD to the ground path 96 via carriage connection flex cable 86. This would reduce or eliminate the need to maintain close spacing between the carriage 82 and the pen housing 12. Therefore the protection afforded our invention should only be limited in accordance with the scope of the following claims.

We claim:

1. An ink-jet printer, comprising:

a carriage configured for receiving and supporting a pair of ink jet pens in side-by-side relation;

driver electronics for the ink-jet pens; and means for providing electrical connection between the pens and the driver electronics once the pens have been fully inserted into the carriage including a flex cable in the carriage having a pair of extended portions on opposite sides thereof for each contacting a corresponding one of the pens during insertion into the carriage and shunting electrostatic discharge (ESD) from the pens to ground before full insertion of the pens.

2. The printer of claim 1 wherein the extended portions are constructed and configured so that the extended portions initially remain in a predetermined free floating intercept orientation and will thereafter fold to a retracted orientation as the pens are progressively inserted into the carriage.

3. The printer of claim 2 wherein the extended portions are constructed and configured so that upon removal of the pen from the carriage the extended portions will spring back to the predetermined intercept orientation.

4. The printer of claim 1 wherein the extended portions have a conductive trace with a portion exposed and positioned for contacting the corresponding pen when the pens are inserted into the carriage.

5. The printer of claim 4 wherein the exposed portion of the trace is plated with a metal to ensure shunting of the ESD.

6. The printer of claim 1 wherein the extended portions are configured as a generally C-shaped loop with an open region that surrounds a plurality of conductive dimples on the flex cable.

7. The printer of claim 1 wherein the extended portions are each secured to a corresponding sidewall of the carriage and have an exposed conductive pad that makes electrical contact with the corresponding pen upon insertion of the pen into the carriage.

8. The printer of claim 1 wherein the driver electronics are provided by a printed circuit assembly (PCA) selected from the group consisting of a carriage PCA and a main PCA.

9. The printer of claim 1 wherein the flex cable is made of a plastic film substrate with conductive traces formed thereon.

10. A printer, comprising:

a carriage for removably receiving and supporting a pair of pens in side-by-side relation;

driver electronics for the pens; and a flex cable that provides electrical connection between the pens and the driver electronics once the pens have been operatively mounted in the carriage, the flex cable having a pair of extended portions on opposite sides thereof for each contacting a corresponding one of the pens during insertion into the carriage and shunting electrostatic discharge (ESD) from the pens to ground before the pens are operatively mounted in the carriage.

11. The printer of claim 10 wherein the extended portions are constructed and configured so that the extended portions initially remain in a predetermined free floating intercept orientation and will thereafter fold to a retracted orientation as the pens are progressively inserted into the carriage.

12. The printer of claim 10 wherein the extended portions are constructed and configured so that upon removal of the pens from the carriage the extended portion will spring back to the predetermined intercept orientation.

13. The printer of claim 10 wherein the extended portions have a conductive trace with a portion exposed and positioned for contacting the correspondending pen when the pens are inserted into the carriage.

14. The printer of claim 13 wherein the exposed portion of the trace is plated with a metal to ensure shunting of the ESD.

15. The printer of claim 10 wherein the extended portions are configured as a generally C-shaped loop with an open region that surrounds a plurality of conductive dimples on the flex cable.

16. The printer of claim 10 wherein the extended portions are each secured to a corresponding sidewall of the carriage and have an exposed conductive pad that makes electrical contact with the corresponding pen upon insertion of the pens into the carriage.

17. The printer of claim 10 wherein the driver electronics are carried fsby the carriage.

18. An ink-jet printer, comprising:

a frame;

a carriage configured to removably receive and support at least one pen;

means for supporting and laterally reciprocating the carriage on the frame;

driver electronics for the pen;

means for propelling a sheet of media longitudinally past the pen; and a flex cable mounted in the carriage for providing an electrical connection between the driver electronics and the pen when the pen is fully inserted into the carriage and including at least one extended portion having a conductive trace with an exposed portion that contacts the pen during an initial phase of insertion into the carriage to shunt electrostatic discharge (ESD) from the pen to ground before the extended portion folds to allow the pen to be fully inserted into the carriage.

19. An ink-jet printer, comprising:

a carriage for receiving and supporting at least one ink-jet pen;

driver electronics for the ink-jet pen; and means for providing electrical connection between the pen and the driver electronics once the pen has been fully inserted into the carriage including a flex cable in the carriage having at least one extended portion including a conductive trace with a portion exposed and positioned for contacting the pen when the pen is inserted into the carriage and shunting electrostatic discharge (ESD) from the pen to ground before full insertion of the pen.

20. The printer of claim 19 wherein the extended portion is constructed and configured so that the extended portion initially remains in a predetermined free floating intercept orientation and will thereafter fold to a retracted orientation as the pen is progressively inserted into the carriage.

21. The printer of claim 20 wherein the extended portion is constructed and configured so that upon removal of the pen from the carriage the extended portion will spring back to the predetermined free floating intercept orientation.

22. The printer of claim 19 wherein the exposed portion of the trace is plated with a metal to ensure shunting of the ESD.

23. The printer of claim 19 wherein the extended portion is configured as a generally C-shaped loop with an open region that surrounds a plurality of conductive dimples on the flex cable.

24. The printer of claim 19 wherein the extended portion is secured to a sidewall of the carriage and has an exposed conductive pad that makes electrical contact with the pen upon insertion of the pen into the carriage.

25. The printer of claim 19 wherein the driver electronics are provided by a printed circuit assembly (PCA) selected from the group consisting of a carriage PCA and a main PCA.

26. The printer of claim 19 wherein the flex cable is made of a plastic film substrate with conductive traces formed thereon.

27. A printer, comprising:

a carriage for removably receiving and supporting at least one pen;

driver electronics for the pen; and a flex cable that provides electrical connection between the pen and the driver electronics once the pen has been operatively mounted in the carriage, the flex cable having at least one extended portion for contacting the pen during insertion of the pen into the carriage and shunting electrostatic discharge (ESD) from the pen to ground before the pen is operatively mounted in the carriage, and the extended portion being configured as a generally C-shaped loop with an open region that surrounds a plurality of conductive dimples on the flex cable.

28. The printer of claim 27 wherein the carriage is configured to support a pair of pens in side-by side relation and the flex cable in the carriage has a pair of extended portions on opposite sides thereof for each contacting a corresponding one of the pens during insertion into the carriage and shunting ESD to ground.

29. The printer of claim 27 wherein the extended portion is constructed and configured so that the extended portion initially remains in a predetermined free floating intercept orientation and will thereafter fold to a retracted orientation as the pen is progressively inserted into the carriage.

30. The printer of claim 29 wherein the extended portion is constructed and configured so that upon removal of the pen from the carriage the extended portion will spring back to the predetermined free floating intercept orientation.

31. The printer of claim 27 wherein the extended portion has a conductive trace with a portion exposed and positioned for contacting the pen when the pen is inserted into the carriage.

32. The printer of claim 31 wherein the exposed portion of the trace is plated with a metal to ensure shunting of the ESD.

33. The printer of claim 27 wherein the extended portion is secured to a sidewall of the carriage and has an exposed conductive pad that makes electrical contact with the pen upon insertion of the pen into the carriage.

34. The printer of claim 27 wherein the driver electronics are carried fsby the carriage.

* * * * *